US006916389B2

(12) United States Patent
Pesiri et al.

(10) Patent No.: US 6,916,389 B2
(45) Date of Patent: Jul. 12, 2005

(54) PROCESS FOR MIXING PARTICULATES

(75) Inventors: David Richard Pesiri, Laguna Beach, CA (US); Robert C. Dye, White Rock, NM (US)

(73) Assignee: Nanotechnologies, Inc., Austin, TX (US)

( * ) Notice: Subject to any disclaimer, the term of this patent is extended or adjusted under 35 U.S.C. 154(b) by 63 days.

(21) Appl. No.: 10/217,852

(22) Filed: Aug. 13, 2002

(65) Prior Publication Data

US 2004/0031754 A1 Feb. 19, 2004

(51) Int. Cl.[7] ..... D03D 23/00; C06B 45/00
(52) U.S. Cl. ..... 149/109.6; 149/2
(58) Field of Search ..... 149/109.6, 2, 37

(56) References Cited

U.S. PATENT DOCUMENTS 4,151,075 A 4/1979 Othmer
4,483,276 A 11/1984 Lomas et al.
4,734,227 A 3/1988 Smith
5,884,138 A 3/1999 Chalasani et al.
5,935,514 A 8/1999 Ford, Jr. et al.
6,113,795 A 9/2000 Subramaniam et al.

FOREIGN PATENT DOCUMENTS

EP 0105980 B1 4/1984
EP 0105980 A1 4/1984
EP 0920921 A2 6/1999
WO WO00/29096 5/2000

*Primary Examiner*—Aileen Felton
(74) *Attorney, Agent, or Firm*—Winstead Sechrest & Minick P.C.

(57) ABSTRACT

A process for producing a mixture of particulates using compressed gas and sonication. The process is particularly useful to mix reactive particulates, such as thermites.

140 Claims, 4 Drawing Sheets

PROCESS FOR MIXING PARTICULATES

GOVERNMENT RIGHTS

The U.S. government has certain rights in this invention pursuant to contract number DAAE30-01-1098 from the U.S. Army (TACOM-ARDEC), Picatinny Arsenal, N.J.

FIELD OF THE INVENTION

The present application relates to a process of forming particulate mixtures, and to an apparatus for performing the process.

BACKGROUND OF THE INVENTION

Traditional processes for mixing particulates use organic solvents as a medium to mix and carry the particulates. These processes have the disadvantage that, once the particulates are mixed, the organic solvent must be removed from the mixed particulates. Where the particulates are energetic, as in the case of thermites, the process of solvent removal increases the risk of an undesirable or uncontrolled reaction. The use of organic solvents also increases the cost to capture, remove, and/or dispose of organic solvent, and the residue from an organic solvent can be undesirable for some applications. The removal of an organic solvent also requires an additional process step in large scale formulation and delivery schemes. Additional handling of energetic mixtures may increase the risk of an explosion. A process is needed for mixing ultrafine materials which avoids these problems while producing a well-mixed end product.

SUMMARY OF THE INVENTION

The present application provides a process for producing a mixture of particulates comprising: forming a dispersion comprising at least a first particulate material and a second particulate material dispersed in compressed gas under mixing conditions comprising a temperature and a pressure effective to maintain at least a portion of said compressed gas in liquid phase and comprising agitation conditions effective to produce substantially no agglomeration, said agitation conditions comprising sonication; and, separating said compressed gas from said mixed dispersion, producing said mixture of particulates.

DESCRIPTION OF THE INVENTION

Figure 1:
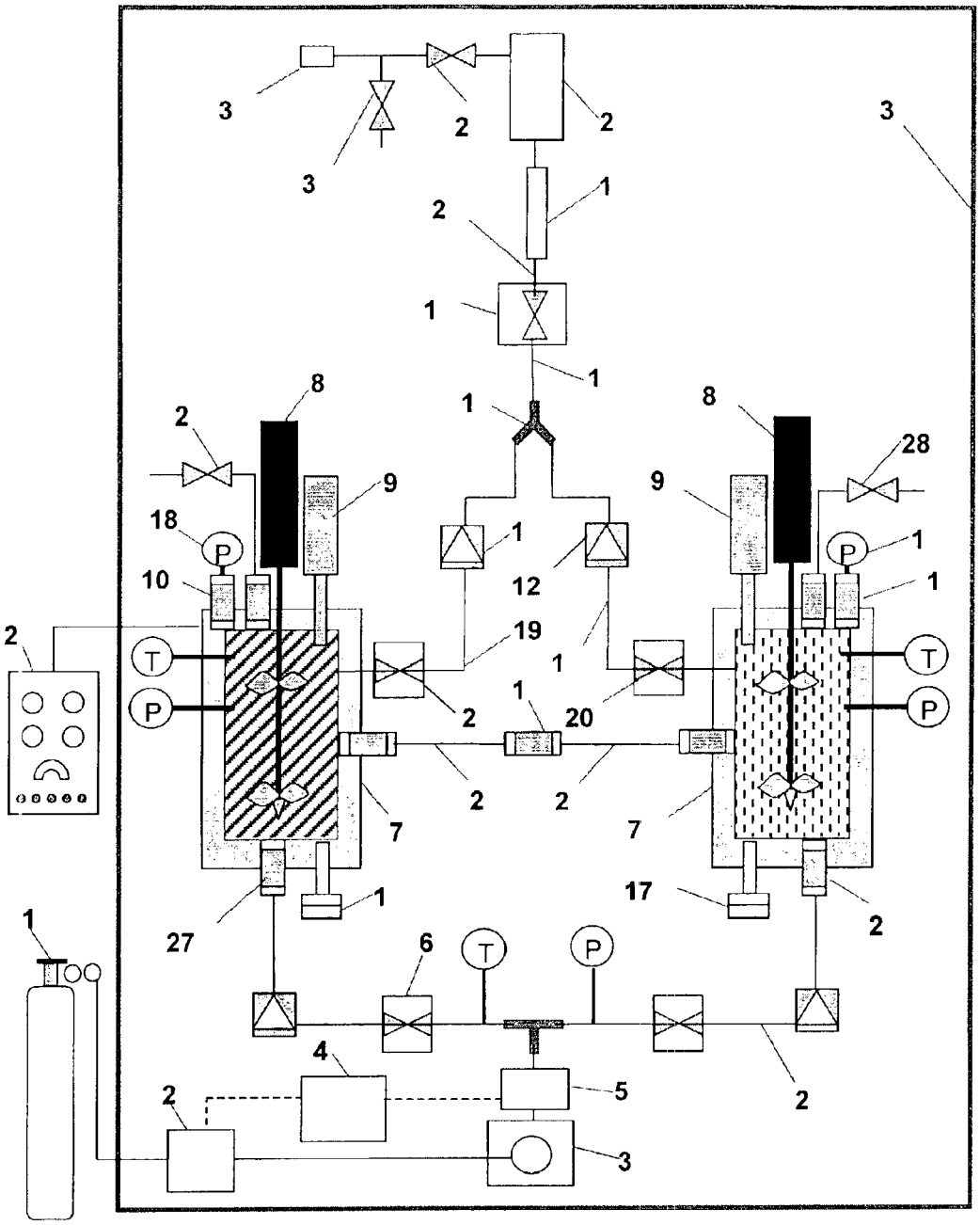
FIG. 1 is a schematic drawing showing a preferred apparatus for mixing superthermites, defined below.

The present application provides a process for producing mixtures of particulates. The process avoids the need to use an organic solvent. At least one dispersion is formed comprising at least two particulates dispersed in compressed gas. In a preferred embodiment, at least two separate dispersions are formed comprising different particulates.

The process is especially useful in processing reactive particulates, defined as particulates which react with one another exothermically. Where the particulates are reactive particulates, it is preferred to form a separate dispersion for each reactive particulate.

Where two or more dispersions are formed, the dispersion (s) are carried to a mixing zone. In a preferred embodiment, agglomeration is prevented using sonication. When the mixed particulates are exposed to reduced pressure, preferably slightly above atmospheric pressure, the compressed gas flashes off, leaving a dry, substantially uniform particulate product mixture.

The Particulates

The particulates processed using the method generally may have substantially any composition. Examples of suitable particulates include, but are not necessarily limited to reactive particulates, metals, ceramics, polymeric materials, oxides, nitrides, borides, silicides, phosphites, sulfides, oxynitrides, carbides, carbonitrides, intermetallic compounds, organometallic compounds, and nanocomposite materials. Cosolvents may be used to offer increased solubililty or desirable powder properties.

In a preferred embodiment, the particulates comprise reactive particulates. The reactive particulates comprise at least a first reactive particulate and a second reactive particulate which, when exposed to one another, react exothermically. In a preferred embodiment, the first reactive particulate comprises at least a primary component, preferably a metal, and the second reactive particulate comprises a reaction product between at least a major component, preferably a different metal, and at least one reactive element. The reaction product of the major component and the reactive element has a higher heat of formation than the reaction product of the primary component and the reactive element. Hence, the exothermic reaction. Suitable reactive particulates have a thermodynamic energy density of from about 10 kJ/cc to about 20 kJ/cc, preferably about 17 kJ/cc, and most preferably 17.1 kJ/cc.

Preferred reactive particulates undergo redox reactions. Preferred reactive particulates comprise a first metal particulate and an electron donating particulate. The electron donating particulate comprises a second metal and an electron carrying group, preferably an oxidizing agent. Upon mixing of the reactive particulates, the electron carrying group of the electron donating particulate reacts exothermically with the first metal to produce a particulate comprising the first metal and the electron carrying group, preferably an oxide of the first metal. In a preferred embodiment, as explained above, the reaction is exothermic, or produces heat.

In this preferred embodiment, suitable first metals include, but are not necessarily limited to, calcium, magnesium, sodium, lithium, aluminum, boron zirconium, titanium, yttrium, silicon, and zinc. Silicon is not a metal, but it is capable of acting like the other metals in this group, and is included as a "first metal" for convenience in terminology. A preferred first metal is aluminum, most preferably a nanoaluminum.

Suitable second metals include, but are not necessarily limited to copper, and molybdenum, titanium, iron, and magnesium. Preferably, the second metal is selected from the group consisting of copper and molybdenum, most preferably molybdenum.

Suitable electron donating particulates comprise an electron carrying group which forms stable products with both the first metal and with the second metal, but which reacts more readily at a lower heat of formation with the first metal. Examples of suitable electron carrying groups include, but are not necessarily limited to oxygen, halogens, and sulfur, preferably oxygen and halogens. More preferred electron carrying groups are selected from the group consisting of oxygen, chlorine, bromine and fluorine. A most preferred electron carrying group is oxygen.

Table 1 lists examples of reactive particulate pairs that are useful in the present application, as well as the products of their reactions and the estimated heats of each reaction per gram of reactant. The heats of the following reactions were calculated by subtracting the heats of formation of the reactants from those of the products.

TABLE 1

Estimated Heats of Reaction For Selected Reactions

| | kJ/g |
|---|---|
| $3Cu(ClO_4)_2 + 16Al \rightarrow 8Al_2O_3 + 3Cu + 3Cl_2$ | −10.5 |
| $Cu(NO_3)_2 + Al \rightarrow 2Al_2O_3 + Cu$ | −10.5 |
| $3CuO + 2Al \rightarrow Al_2O_3 + 3Cu$ | −4.2 |
| $Fe_2O_3 + 2Al \rightarrow Al_2O_3 + 2Fe$ | −4.2 |
| $Ca + S \rightarrow CaS$ | −6.7 |
| $Mg + CuO \rightarrow MgO + Cu$ | −4.2 |
| $TiF_4 + 2Ca \rightarrow 2CaF_2 + Ti$ | −3.8 |
| $2Na + S \rightarrow Na_2S$ | −4.6 |
| $Mg + S \rightarrow MgS$ | −6.3 |
| $TiF_4 + 4Li \rightarrow LiF + Ti$ | −5.0 |
| $2Al + MoO_3 \rightarrow Al_2O_3 + Mo$ | −4.6 |
| $Al + MnO \rightarrow Al_2O_3 + Mn$ | −5.0 |

As shown in Table 1, suitable reactive particulate pairs include, but are not necessarily limited to: $CuClO_4$ and Al; $Cu(NO_3)_2$ and Al; CuO and Al; $Fe_2O_3$ and Al; S and Ca; CuO and Mg; $TiF_4$ and Ca; S and Na; S and Mg; $TiF_4$ and Li; MnO and Al; and, $MoO_3$ and Al.

Preferred reactive pairs are superthermites, most preferably nanoaluminum and molybdenum trioxide ($MoO_3$). Nanoaluminum has a thermodynamic energy density of 84 kJ/cc to complete oxidation with molecular oxygen. The superthermites have a thermodynamic energy density of from about 10 kJ/cc to about 20 kJ/cc, most preferably about 17.1 kJ/cc. Al/$MoO_3$ typically has a flame temperature of about 3850° C. Methods of making such particulates are known in the art. Preferred particulates are commercially available from a number of sources, including but not necessarily limited to Nanophase Technologies, Inc., Argonide Corporation, Aveka, Inc., Technanogy, LLC, Climax Molybdenum GmbH, S, and Shepherd Chemical Company.

Generally, the electrical, chemical, mechanical, optical, and magnetic properties of the particulates are selectively controlled by engineering the size, morphology, and composition of the particulates using known techniques.

Suitable particulates have substantially any morphology. Suitable morphologies include, but are not necessarily limited to spherical, round, flat, dendritic, laminar, fibrous or branched shapes, while the term may also refer to an individual material or mixtures of materials. Typically, nanoaluminum is a spherical particulate and $MoO_3$ is a rod-shaped particulate.

Suitable particulates have substantially any size as long as the size is sufficiently small to be dispersed in the compressed gas under the conditions of operation. In a preferred embodiment, the particulates have a maximum outer diameter of from about 5 nanometers (nm) to about 20 microns. In general, nanoscale particulates are preferred. Nanoscale particulates have a maximum outer diameter of 100 nm or less, preferably less than 100 nm. Most preferred nanoscale particulates have a maximum outer diameter of from about 40 nm to about 60 mm.

Where the reactive particulates are metals, the particulates sometimes tend to form oxide coatings. At least some oxide coating is desirable for some metals because an oxide coating tends to prevent agglomeration of the particulate mixture when collected and stored. The thickness of the oxide coating may be varied using known conditions. Typically, the oxide coating thickness is from about 1.5 nm to about 4.0 nm. Preferably, the oxide coating thickness on nanoaluminum particulates is from about 2.0 nm to about 2.5 nm. Thinner oxide coatings may be used, but they are not preferred because the resulting powder tends to be sensitive to shock, friction and exposure to air and water.

The surface area of the particulates will vary depending on their composition and intended use. Where the particulates are reactive particulates, the surface area of the first metal particulate is from about 15 $m^2/g$ to about 150 $m^2/g$. The surface area of the electron donating particulate is from about 20 $m^2/g$ to about 60 $m^2/g$. In superthermites, the specific surface area of the superthermite particulate product is from about 35 $m^2/g$ to about 49 $m^2/g$. The aluminum content of superthermite mixtures ranges from about 40% to about 75% of the total mass.

Compressed Gas

The particulates are mixed using a solventless medium, preferably a compressed gas. Suitable compressed gases include, but are not necessarily limited to inert gases, hydrocarbons, fluorocarbons and carbon dioxide. A suitable inert gas is xenon. Preferred hydrocarbons have from about 1 to about 10 carbon atoms. A preferred compressed gas is carbon dioxide. The compressed gas need not be completely inert to the particulates as long as any interaction between the gas and the particulates does not affect the final composition of the product mixture.

Suitable compressed gases are effective to disperse the particulates in the gas and to form a dispersion of the particulates in the compressed gas. The dispersion preferably has fluid-like properties at temperatures and pressures of operation. The fluid-like properties permit the dispersion to flow from one location to another in the system.

Preferably, the compressed gas is maintained at a pressure above the vapor pressure of the gas to ensure a liquid phase throughout the entire volume. Suitable temperatures and pressures will vary with the particular gas and with the conditions of operation. Generally, the temperature required to maintain a liquid phase decreases as the pressure increases. Hence, at least one of the temperature or the pressure is sufficient to maintain the compressed gas in a liquid phase. In some instances, it may be desirable to maintain the compressed gas in the supercritical phase. Typically, supercritical conditions are not required where solubility is not an issue, such as when the particulates are inorganic. However, where the particulates are organic, supercritical conditions typically are desirable.

Compressed $CO_2$ is a preferred compressed gas, especially for mixing energetic particulates, because (a) $CO_2$ has a relatively low surface tension, which allows for favorable wetting of the particulates and thus for dispersion of the particulates in the $CO_2$, and (b) $CO_2$ provides for adequate absorption and discharge of the heat generated from the energy input for mixing energetic particulates. $CO_2$ is not completely inert to the molybdenum oxide and aluminum particulates. In principle, $CO_2$ can react with Al and aluminum nanopowder does burn in a $CO_2$ atomosphere. However, the thermal buffering of the liquid $CO_2$ is relied upon to prevent a sustained reaction.

Compressed $CO_2$ provides fluid like properties, but is sufficiently nonflammable to maintain the combustion stability of energetic particulates under conditions of operation. For example, compressed $CO_2$ does not tend to oxidize or reduce the energetic material under typical conditions of operation. Compressed $CO_2$ also provides for thermal buffering of the energetic materials. Where the compressed gas is carbon dioxide, suitable temperatures for conducting the process are from about 0° C. to about 150° C., preferably from about 10° C. to about 32° C., more preferably about 31.1° C. or less, most preferably about 20° C. Suitable pressures are from about 70 bar to about 170 bar, preferably about 120 bar. At the conditions of operation, the compressed gas preferably has a density between that of a gas and that of a liquid, or from about 0.5 g/cm$^2$ to about 1.1. g/cm, preferably about 1.0 g/cm$^2$. At the conditions of operation, the fluid preferably has a viscosity of at least about $1.2\times10^{-4}$ Pa-s.

Apparatus

In one embodiment, which is suitable for mixing non-reactive particulates, the apparatus comprises a source of compressed gas, at least one mixing zone, and a collector. This embodiment may use any suitable pressure vessel. The particulates are supplied to the pressure vessel and compressed gas is fed to the vessel with mixing, and preferably with sonication.

In a preferred embodiment, preferably for mixing reactive particulates, the apparatus comprises a source of compressed gas, at least two dispersion vessels, a mixing zone, and a collector.

Source of Compressed Gas

The source of compressed gas 1 preferably is a pressurized cylinder of a suitable gas. In FIG. 1, the source of compressed gas comprises a carbon dioxide cylinder 1. The carbon dioxide cylinder 1 is in fluid communication 30 with each dispersion vessel 7, 7*a*. To eliminate $CO_2$ flashing in the pump 3, the carbon dioxide is pre-cooled using a pre-cooling heat exchanger 2. The pre-cooled $CO_2$ flows to the pump 3. The pump 3 delivers the $CO_2$ from the cylinder 1 to the dispersion vessels 7,7*a* at a pressure of from about 70 bar to about 170 bar, preferably about 120 bar. Prior to entering the dispersion vessels 7, 7*a*, the temperature of the $CO_2$ is maintained by a high-pressure heat exchanger 5. High-pressure ball valves 6 are located between the pump 3 and the mixing vessels 7, 7*a* to control flow and prevent backflow of material. Preferably, check valves are located between each ball valve and the mixing vessel. Preferred pumps, mixers, and sonicators are capable of being operated individually or remotely. For safety during operation, mixing is preferably performed in an enclosure, preferably within a polycarbonate closure on all four sides and the top.

A chiller 4 is provided for the efficient pumping of carbon dioxide. Carbon dioxide from the pump 5 and/or the chiller 4 flows to a high pressure heat exchanger 5 and from there through pneumatic ball valves 6 and into the mixing vessels 7, 7*a*.

Dispersion Vessel

Suitable dispersion vessels provide for temperature and pressure control within the vessel. As seen in the apparatus of FIG. 1, a first dispersion vessel 7 and a second dispersion vessel 7*a* are in fluid communication 30 with the source of compressed gas 1. Each dispersion vessel 7, 7*a* comprises a source of agitation, a source of sonication, a pressure and temperature sensor 18, 18*a*, a relief valve 28, 28*a*, a porous metal snubber 10, and a rupture disk (preferably 2500 psi) 17. A "pressure bridge" 11 is provided between the first dispersion vessel 7 and the second dispersion vessel 7*a*.

The actual dispersion vessels may have substantially any configuration as long as the vessel(s) define an enclosure adapted to retain the dispersion at the pressures and temperatures of operation. In a preferred embodiment, the vessel is substantially cylindrical with minimal "dead spots." Dead spots may be avoided by using substantially rounded bottoms. Persons of ordinary skill in the art will be able to adapt the size of the dispersion vessel depending upon the quantity of product to be produced over a particular time period.

For production on the scale of about 200 g/hr superthermites, effective dispersion vessels comprises a volume of from about 2 liters to about 10 liters, most preferably about 5 liters, with a depth to diameter ratio of about 0.5 to 1.5. At five liters, the dispersion vessels 7, 7*a* can be operated at lower solids loadings (i.e., more dilute), preferably at a solids loading of about 5% or less, most preferably about 2 wt. % or less. In a preferred embodiment, the dispersion vessels 7, 7*a* preferably are self-sealing having a "c" cup seal made of graphite reinforced Teflon®. and all tubing is preferably ⅛" to ¼" stainless steel tubing.

The pressure and temperature in the dispersion vessels are preferably maintained by sensors. A preferred material of construction for a dispersions vessels is 304 stainless steel. Preferably, the dispersion vessels are self-sealing having a "c" cup seal made of graphite reinforced Teflon®.

A preferred dispersion vessel comprises a source of agitation and a source of sonication. Mixing performed in high-pressure closed mixing vessels is commonly accomplished in one of two ways: (1) using mechanically driven stirring elements, or (2) using magnetically coupled stirring elements. Where the particulates are not reactive particulates, such as thermites, the source of agitation may include substantially any mechanical agitation device, including but not necessarily limited to high-speed impellers (turbine agitators and propeller agitators), paddle agitators, and homogenizers. Mechanical mixers are very powerful but have the liability of relying on seals and gaskets with limited lifetimes. Also, mechanical stirrers are subject to the buildup of significant static in the mixing vessel. The unacceptable risk associated with static buildup precludes the use of a mechanical stirrer when mixing thermites.

Preferred stirrers for use in mixing reactive particulates are magnetically coupled stirrers, which rely on a magnetic coupling between the motor 8 and impeller shaft 29 to produce the stirring motion. In the preferred embodiment shown in FIG. 1, the dispersion vessel 7 comprises a magnetically coupled stirrer 8, 29. A preferred magnetically coupled stirrer comprises a 14" long, 4.5" diameter, three-impeller 16 in/-lb torque shaft 29. The flow pattern created by this preferred magnetically coupled stirrer 8, 29 includes a distinct axial flow pattern along the entire mixing vessel and strong axial currents that follow the vessel geometry all the way outward from the stirrer. The stirrer 8, 29 preferably generates a turbulent flow in the mixture at a rated of about 6 nm at about 2500 rpm.

The source of sonication may be substantially any sonochemical apparatus effective to assist in forming a dispersion and reducing agglomeration of the particulates. A preferred sonochemical apparatus includes an ultrasonic probe 9 having ultrasonic energy in the range of from about 100 Watts to about 750 Watts, most preferably about 200 Watts. Preferably, the probe is mounted on the lid of the mixing vessel and sealed using an o-ring.

In order to form effective dispersions, the particulates must be properly wetted, physically separated, and stabilized. When the particulates are wetted while sonicating, air is released from the bulk packing of the particulates. Once the air is released, the agitator separates and distributes the particulates throughout the compressed gas. Once an effective dispersion is formed, the ultrasonic energy prevents reagglomeration of the particulates.

The tubing used to feed the dispersions from the dispersion vessels 7,7*a* to the mixing zone preferably is fitted to maintain a pressure of from about 90 bar to about 440 bar, most preferably about 330 bar. A preferred tubing is ¼" stainless steel having a wall thickness of about 0.049".

Mixing Zone

Each mixing vessel 7, 7*a* is in fluid communication with a mixing zone 14, preferably via suitable chemically resistant high performance tubing, most preferably ¼" stainless steel tubing 19. To maintain the rate of mixing and to control unwanted or surplus mixing of the dispersions, a preferred apparatus incorporates three levels of control: (1) high torque ball valves 12*a* effective to control the rate of delivery of dispersions from the mixing vessels 7, 7*a* to the mixing zone 14 at pressures of from about 1 to about 3000, preferably about 2500; (2) check valves 12*b*, located downstream from the ball valves 12*a*, effective to minimize plugging of the high torque ball valves 12*a* by preventing flow of dispersions in reverse direction (backflow) back past the ball valves 12*a*; and (3) a "pressure bridge" 11 that connects and equalizes the pressure between the mixing vessels 7, 7*a* by allowing $CO_2$ to pass between the bridge. In the embodiment shown in FIG. 1, a series of filters are used to prevent particulate exchange between the mixing vessels 7, 7*a*. A preferred ball valve 12*a* is equipped with a Swagelock actuator designed to produce enough torque to close the ball valve 12*a* under all operating circumstances. Preferably, the check valves 12*b* are manually operated.

Where the particulates are not reactive particulates, the mixing zone 14 may comprise a mixing vessel comprising substantially any configuration as long as the mixing vessel defines an enclosure which retains the dispersion at the pressures and temperatures of operation and which permits adequate mixing of the dispersions. Suitable mixing vessels include, but are not necessarily limited to, pan mixers, horizontal trough mixers, shearing devices, and in-line mixers. Preferred mixing vessels include static or motionless mixers, preferably comprising ¼" stainless steel tubing. Suitable static mixers are of cylindrical length and incorporate mixing elements, preferably fins, obstructions, or channels mounted in the mixing vessel. Suitable mixing of the dispersions is achieved by producing multiple flow patterns of the particulates in the compressed gas. Preferably, mixing is accomplished by the displacement and distortion, cutting and twisting, acceleration and retardation, and separation and reuniting of the nanoscale particulates in the compressed gas. The volume of the mixing vessel will vary depending upon the particulates mixed, the compressed gas, and the temperatures and pressures of operation, among other things. The contact interval, the mechanical intensity inside the mixer, the composition of particulates, the size of particulates, and viscosity of the compressed gas, also will vary and influence the quality of the resulting mixture.

Where the particulates are reactive, the mixing vessel preferably minimizes the contact interval and, when combined with the buffering effect of the solvent, prevents redox reactions between the reactive particulates. A preferred mixing vessel for reactive particulates is an unobstructed Y-type fitting 13. A Y-type fitting 13 also minimizes plugging compared to that found using right angle fittings. A most preferred mixing vessel for reactive particulates is a Y-type fitting having opposed angles of from about 100° to about 150°; most preferably about 120°.

A needle valve, preferably a low impedance needle valve and a control valve 15, preferably a manual control valve for controlling the outlet flow rate of the mixture are provided between the mixing zone 14 and a collection vessel 22. The control valve 15 serves as the backpressure regulator. Preferred control valves comprise high strength SS seats, preferably SS 316, and pistons capable of controlling mixtures with flow rates of from about 50 g/min to about 350 g/min, preferably 200 g/min. Preferred valves 15 are bellows valves and are effective at temperatures of from about −10° C. to about 300° C., preferably about 20° C.; and at the pressures described.

The collection vessel 22 preferably comprises a nozzle 16 for feeding product to the collection vessel 22. The apparatus also preferably comprises a shield 34, preferably a polycarbonate shield on all four sides and top of the apparatus; and an automated control system 21 located outside of the shield.

Collection Vessel

The particulates exiting the system achieve a very high velocity and are difficult to control. A preferred collection vessel is designed to capture these high-pressure particulate product streams as they are delivered through the nozzle 16. Prior to being fed to a collection vessel 22, the liquid $CO_2$ preferably is heated with a vaporizer 32 at about 50° C. to about 150° C., preferably about 110° C., to insure that all of the liquid $CO_2$ is converted to gas during depressurization. A preferred vaporizer can effectively heat the liquid $CO_2$ at flow rates from about 100 g/min to about 350 g/min, preferably about 200 g/min, and at the pressures previously described.

Figure 2:
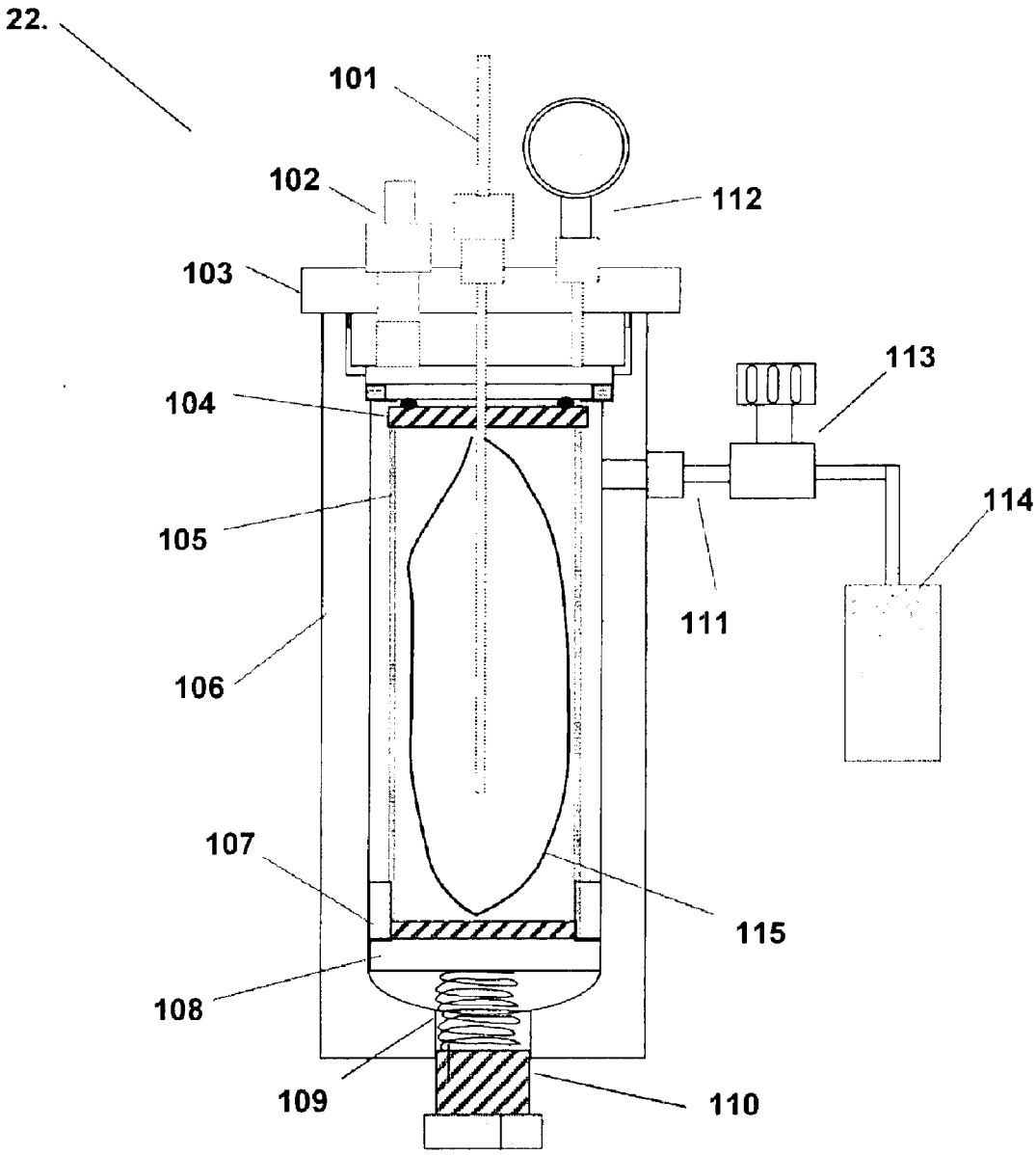
FIG. 2 is a schematic of a suitable collection vessel.

Referring to FIG. 2, a preferred collection vessel 22 comprises an inlet 101, preferably, a ¼" steel inlet, in fluid communication with the nozzle 16 and collection vessel 22. The collection vessel 22 preferably comprises a pressure relief device 102, suitably a rupture disk, preferably a 2000 psi rupture disk, that provides pressure relief including a two-stage pressure drop from operating pressure of from about 120 bar to an intermediate pressure of about 35 bar. The collection vessel 22 further includes a cover 103, preferably a threaded cover; an o-ring seal 104 between the cover 103 and a inner powder filter 105, preferably a 10-micron grade sintered stainless steel filter effective to collect high pressure powder streams; and a pressure vessel 106 preferably comprising a slotted filter housing and capable of pressures from about 70 bar to about 1375 bar, most preferably 1375 bar. A spring loaded bottom plate 107, a spring 108, preferably a ¾" spring, and a threaded plug 109, preferably ½" threaded plug, provide a seal to filter as the collection vessel 22 is filled with particulate product streams. The collection vessel is further fitted with an outlet 110, preferably a ¼" outlet, a pressure gauge 111, a back pressure regulator valve 112, preferably manually operated, and a filter 113, preferably a porous metal silencer/guard filter effective to 35 bar. The collection vessel preferably is fitted with an inner liner 115, preferably an inner fabric bag which is removable, conductive, and properly grounded. The outlet tube preferably is fitted with a velocity reducer plate to slow the momentum of the $CO_2$ stream and the particles. The exit guard preferably is fitted to the tube end and allows the powder to exit through openings at the side.

The delivery of fine particulates from a high pressure $CO_2$ stream can cause a sizeable static charge to accumulate. Where the product is superthermites, which requires a static free environment, proper grounding, static control and static monitoring are required throughout the system.

In a first embodiment, ultrafine particulates, preferably superthermites, most preferably nanoaluminum powder and $MoO_3$ powder are added to individual mixing vessels in a ratio of about 1.5 to 2 parts $MoO_3$ to 1 part nanoaluminum powder. The nanoaluminum powder is dispersed in a first mixing vessel with compressed $CO_2$. The $MoO_3$ powder is dispersed in a second mixing vessel with compressed $CO_2$. Suitable stirring and sonication produces dispersions with substantially no agglomeration of the nanoscale particulates. By "substantially no agglomeration" is meant that discrete particle sizes are achieved down to the minimum base particle/hard aggregate level, i.e., no bonds weaker than covalent or ionic bonds hold individual particles together.

Once an effective dispersion of each reactive particulate is formed, the dispersions flow to the mixing zone, preferably at a pressure of from about 120 bar to about 170 bar, more preferably about 120 bar. The dispersions enter the mixing zone, preferably a Y-shaped fitting, at a steady state velocity of from about 7 m/s to about 700 m/s, preferably about 70 m/s.

Upon entering the mixing zone, the streams preferably contact each other and split, recombine and split again continuously to achieve adequate mixing. Preferably, the contact time lasts less than about 2 seconds. At dispersion levels of about 20 g/l, the amount of particulates being mixed is relatively small compared to the amount of compressed $CO_2$ being fed through the mixer. The short contact interval provided by a preferred static mixer maximizes mixing efficiency while also maintaining the combustion stability of energetic particulates, such as superthermites. Resulting particulate sizes in the superthermite mixtures are substantially the same as the original particle sizes. Once the dispersions are properly mixed, the mixture is collected and brought to atmospheric pressure wherein the compressed $CO_2$ flashes off, leaving a relatively dry, well-mixed product.

Venting directly from the operating pressure of about 1000 psi to ambient conditions causes $CO_2$ expansion and may form dry ice, which may condense on the product after collection. Preferably, collection of the high-pressure mixture comprises a two-stage pressure drop which allows the product to be collected at an intermediate pressure of 25 bar, down from the operating pressure of 1000 psi. Depressurization from 25 bar allows for venting off of the $CO_2$ without dry ice formation at the collection source. Eliminating dry ice formation helps insure the collection of a well-mixed dry end product. Suitably, the mixing process is a continuous or semi-continuous operation producing a powder product on the scale of up to about 25 bar.

In a second embodiment, which is used to mix substantially non-reactive particulates, at least two particulates are added to a single dispersion vessel (not shown) to form a mixed dispersion under stirring and sonication conditions. The particulates may be added to the dispersion vessel in any preferred amount and in any preferred ratio. A compressed gas, preferably compressed $CO_2$, is added to the dispersion vessel in an amount effective for desired mixing and/or dispersion of the particulates. The compressed $CO_2$ has the effect of minimizing the agglomerating ability of particulates under sonication. At temperatures ranging from about 10° C. to about 40° C., compressed $CO_2$ will comprise a density of about 1 g/mL. The rate of dispersion is directly correlated to the density of the compressed $CO_2$, wherein the density of the compressed $CO_2$ decreases with increasing temperature at a given pressure. Preferably, the compressed $CO_2$ is in the liquid state for effective dispersion of the nanoscale particulates. In the above temperature range, the heat generated through sonication of the nanoscale particulates is absorbed or discharged by the compressed $CO_2$. Sonication at about 200 Watts allows for adequate wetting of the nanoscale particulates in the compressed $CO_2$.

Once wet, the particulates disperse throughout the entire mixing vessel under turbulent flow. Sonication allows for the production of a powder mixture comprising a level of mechanical rearrangement not obtained by turbulent flow alone. Once mixing is completed, the mixture is exposed to reduced atmospheric pressure to permit the compressed gas to flash off, leaving a well-mixed, dry product. The system is flushed with $CO_2$ to remove any remaining particulates from the system.

The invention will be better understood with reference to the following example, which is illustrative only and not intended to limit the present invention to a particular embodiment.

EXAMPLE 1

An experiment was run in a mixing vessel to test the effect of dense phase $CO_2$ on aluminum nanopowder. The reductive potential of aluminum is well known and is sufficient to reduce water into hydrogen gas and oxygen or carbon dioxide into carbon and oxygen. Control experiments were run to verify that no reaction would occur between aluminum nanopowder and $CO_2$ at normal operating conditions. A small powder (35 nm) with a thin oxide shell (2.0 nm), 61.0% aluminum content, was selected to represent an extreme test of the reaction. Typically, powders of this quality are the most reactive and have been shown to reduce water the most readily in previous experiments.

Standard mixing conditions were simulated in a single mixing vessel by adding 2.5 grams of aluminum powder from Lot # Al1A to the bottom of the vessel and sealing the material inside. The vessel was pressurized to 70 bar and stirring began at a rate corresponding to 1.4 bar inlet pressure on the pneumatic stirrer. Sonication was performed throughout the entire mixing experiment at 22% output. The vessel held pressure for the duration of the four hours mixing experiment and the contents were then vented through the manual relief valve (⅛" stainless steel tubing with a HiP valve as the outlet).

TABLE

Representative Powder Stability results Using Liquid $CO_2$

| | Lot Al1A Pre-Mixing | Post-Mixing |
|---|---|---|
| Quantity | 2.5 g | 1.6 g |
| BET Surface Area | 55.6 $m^2/g$ | 55.5 $m^2/g$ |
| Average Particle Size | 35.0 nm | 34.9 nm |
| TGA weight gain | 54.2% | 53.3% |
| Aluminum Content | 61.0% | 60.0% |
| Appearance | Dark gray, fluffy | Dark gray, fluffy |

Figure 3:
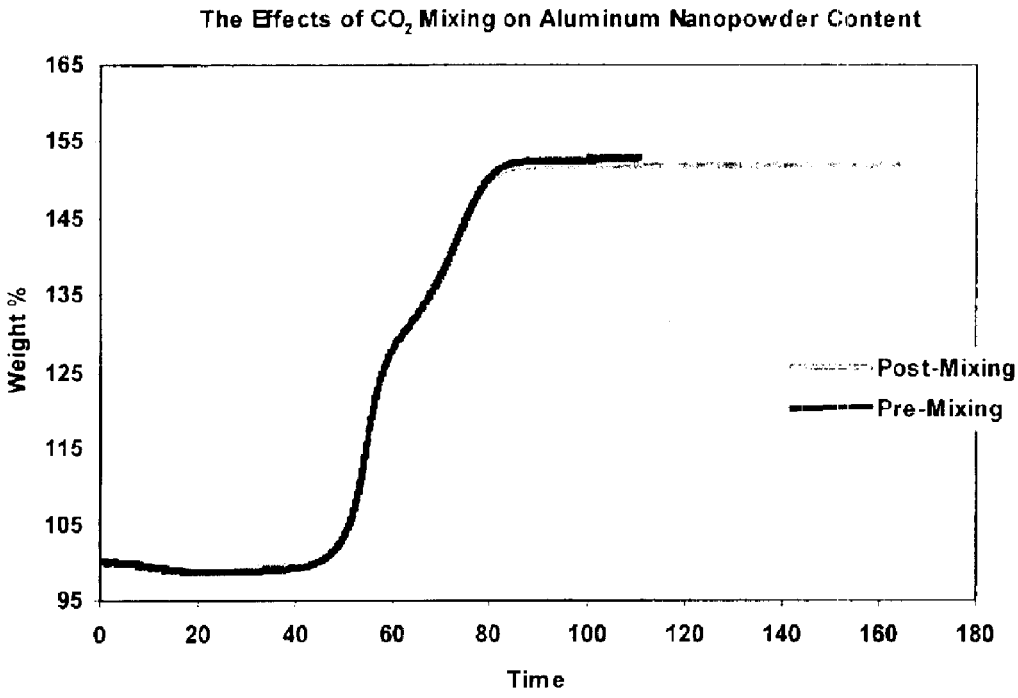
FIG. 3 is a graph, discussed in Example 1, showing the effects of carbon dioxide mixing on aluminum nanopowder content.

The results in FIG. 3 demonstrate the lack of any reactivity between compressed carbon dioxide and nano-aluminum. This graph is the overlay of two thermogravimetric analysis (TGA) runs. The darker data points are the TGA result for nano-aluminum batch Al1A, the powder that was used for many of the mixing experiments. The weight gain of roughly 53% corresponds to an aluminum content of 61% and an oxide shell thickness of 2.0 nm. The lighter data points are TGA data taken from powder that had been pressurized, mixed and sonicated in $CO_2$ at 70 bar for four hours. The TGA data for the pre- and post-$CO_2$ exposure are indistinguishable, suggesting there is no significant reactivity between $CO_2$ and this batch of nanoaluminum.

EXAMPLE 2

The performance of the mixer was tested by mixing aluminum nanopowder with nanometer sized $Al_2O_3$ (alumina). The nano-alumina (purchased from Nanophase Inc.) acted as a surrogate for $MoO_3$ in all mixing experiments. The advantages of nano-alumina as a surrogate for molybdenum trioxide included: the lack of reactivity between Al and $Al_2O_3$; the availability and low cost of high quality nanometer-sized alumina; alumina's inert properties (TGA, in $CO_2$, reactivity with Al etc.); and the contrast in color between $Al_2O_3$ (white) and aluminum nanopowder (black). Shortcomings of alumina as a surrogate for nanoscale $MoO_3$ include: the inability to measure performance data for the mixtures; the inability to distinguish Al and $Al_2O_3$ by electron microscopy; and the difference in shape between alumina (spherical particles) and MoO3 (rod like particles).

The powder was delivered to the collection chamber and analyzed. The TGA and BET are shown in the following Table:

Table Representative Powder Properties for a 50:50 Mixture of Nano-aluminum and Nano-Alumina

| Powder | TGA Weight Gain (%) | BET ($m^2$/g, N2 adsorption) | Diameter | Weight % Al |
|---|---|---|---|---|
| $Al_2O_3$ | 0 | 34.9 | ~50 | 0 |
| 50:50 Mixture | 21.6 | 47.9 | 40.9 | 24.3 |
| Aluminum | 42.8 | 61.4 | 33.3 | 48.2 |

Figure 4:
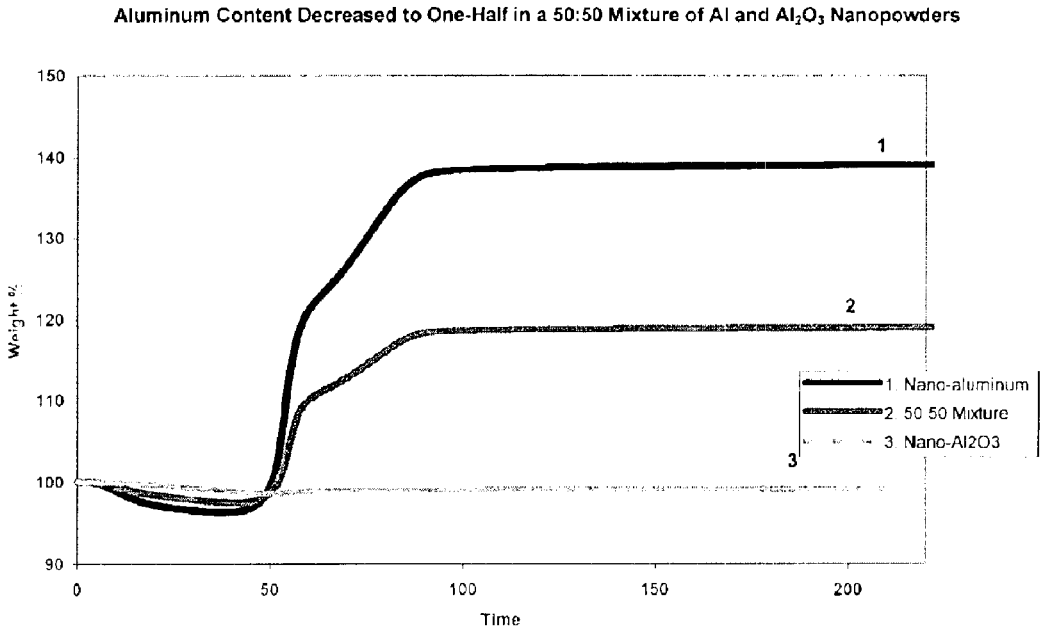
FIG. 4 is a graph, discussed in Example 2, showing an overlay of two thermographic analysis runs detailing the mixing effectiveness.

FIG. 4, which is an overlay of two thermographic analysis runs again demonstrates the lack of any reactivity between compressed carbon dioxide and nano-aluminum, and illustrates the effect of decreasing the aluminum to one half of the mixture.

EXAMPLE 3

This example illustrates the mixing of nanoaluminum powder and molybdenum trioxide powder. In a continuous operation at a collection rate of 200 g/hr, a first five-liter stainless steel mixing vessel is pre-filled with 140 g of nanoaluminum powder and a second five-liter stainless steel mixing vessel is pre-filled with 260 g of molybdenum trioxide powder. Each mixing vessel is sealed and a high-pressure piston pump delivers compressed $CO_2$ from a storage cylinder to each mixing vessel at a pressure of 1000 psi. Once pressurized, each powder solution is vigorously mixed with a magnetically coupled mechanical stirrer within each pressure vessel. Each powder solution is simultaneously exposed to ultrasonic energy at 200 Watts to disperse and wet the particulates within the compressed $CO_2$. Once the solutions are thoroughly dispersed, each solution is fed to a static mixer through ⅛" stainless steel tubing. The dispersions are subjected to multiple flow patterns within the static mixer resulting in a short contact interval between the two dispersions forming superthermites. Once mixed, the superthermites are fed to a collection vessel. The collection vessel is depressurized to atmospheric conditions wherein the high vapor pressure $CO_2$ flashes off resulting in a dry, well-mixed powder product. The resulting superthermite powder includes a molybdenum metal and aluminum oxide formulation generating over 17 kJ/$cm^3$ of heat. The resulting particle size is approximately 50 nm with an outer oxide shell of approximately 2.0 nm.

EXAMPLE 4

This example illustrates the mixing of nanoaluminum powder and copper oxide powder. In a continuous operation at a collection rate of 200 g/hr, a first five-liter stainless steel mixing vessel is pre-filled with 140 g of nanoaluminum powder and a second five-liter stainless steel mixing vessel is pre-filled with 260 g of copper oxide powder. Following the procedure of Example 3, the resulting powder includes a copper and aluminum oxide formulation generating over 21 kJ/cm3 of heat. The resulting particle size is approximately 50 nm with an outer oxide shell of approximately 2.0 nm.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

We claim:

1. A process for producing a mixture of particulates comprising:

forming a first dispersion comprising a first particulate material dispersed in compressed gas under agitation conditions effective to produce substantially no agglomeration, said agitation conditions comprising sonication and a temperature and a pressure effective to maintain at least a portion of said compressed gas in liquid phase;

forming a second dispersion comprising a second particulate material dispersed in compressed gas under said agitation conditions, wherein said first particulate material and said second particulate material comprise reactive particulates;

feeding said first dispersion and said second dispersion to a mixing zone under mixing conditions effective to produce a mixed dispersion comprising said first particulate material and said second particulate material; and separating said compressed gas from said mixed dispersion under collection conditions effective to collect said mixture comprising said first particulate material and said second particulate material.

2. The process of claim 1 wherein said reactive particulates comprise at least a first reactive particulate and a second reactive particulate which undergo an exothermic redox reaction.

3. The process of claim 1 wherein said reactive particulates have a thermodynamic energy density of from about 10 kJ/cc to about 20 kJ/cc.

4. The process of claim 1 wherein said reactive particulates have a thermodynamic energy density of 17 kJ/cc.

5. The process of claim 2 wherein said first reactive particulates comprise a first metal selected from the group consisting of calcium, magnesium, sodium, lithium, aluminum, boron zirconium, titanium, yttrium, silicon, and zinc.

6. The process of claim 3 wherein said first reactive particulates comprise a first metal selected from the group consisting of calcium, magnesium, sodium, lithium, aluminum, boron zirconium, titanium, yttrium, silicon, and zinc.

7. The process of claim 2 wherein said first reactive particulates comprise aluminum.

8. The process of claim 7 wherein said aluminum is a nanoaluminum.

9. The process of claim 2 wherein said second reactive particulates comprise a second metal selected from the group consisting of copper, molybdenum, titanium, iron, and magnesium.

10. The process of claim 2 wherein said second reactive particulates comprise a second metal selected from the group consisting of copper and molybdenum.

11. The process of claim 2 wherein said second reactive particulates comprise a second metal comprising molybdenum.

12. The process of claim 3 wherein said second reactive particulates comprise a second metal selected from the group consisting of copper, molybdenum, titanium, iron, and magnesium.

13. The process of claim 3 wherein said second reactive particulates comprise a second metal selected from the group consisting of copper and molybdenum.

14. The process of claim 3 wherein said second reactive particulates comprise a second metal comprising molybdenum.

15. The process of claim 5 wherein said second reactive particulates comprise a second metal selected from the group consisting of copper, molybdenum, titanium, iron, and magnesium.

16. The process of claim 5 wherein said second reactive particulates comprise a second metal selected from the group consisting of copper and molybdenum.

17. The process of claim 5 wherein said second reactive particulates comprise a second metal comprising molybdenum.

18. The process of claim 6 wherein said second reactive particulates comprise a second metal selected from the group consisting of copper, molybdenum, titanium, iron, and magnesium.

19. The process of claim 6 wherein said second reactive particulates comprise a second metal selected from the group consisting of copper and molybdenum.

20. The process of claim 6 wherein said second reactive particulates comprise a second metal comprising molybdenum.

21. The process of claim 2 wherein said second reactive particulates further comprise an electron carrying group.

22. The process of claim 3 wherein said second reactive particulates further comprise an electron carrying group.

23. The process of claim 9 wherein said second reactive particulates further comprise an electron carrying group.

24. The process of claim 15 wherein said second reactive particulates further comprise an electron carrying group.

25. The process of claim 21 wherein said electron carrying group is selected from the group consisting of oxygen, halogens, and sulfur.

26. The process of claim 21 wherein said electron carrying group is selected from the group consisting of oxygen and halogens.

27. The process of claim 21 wherein said electron carrying group is selected from the group consisting of oxygen, chlorine, bromine and fluorine.

28. The process of claim 21 wherein said electron carrying group comprises oxygen.

29. The process of claim 22 wherein said electron carrying group is selected from the group consisting of oxygen, halogens, and sulfur.

30. The process of claim 22 wherein said electron carrying group is selected from the group consisting of oxygen and halogens.

31. The process of claim 22 wherein said electron carrying group is selected from the group consisting of oxygen, chlorine, bromine and fluorine.

32. The process of claim 22 wherein said electron carrying group comprises oxygen.

33. The process of claim 23 wherein said electron carrying group is selected from the group consisting of oxygen, halogens, and sulfur.

34. The process of claim 23 wherein said electron carrying group is selected from the group consisting of oxygen and halogens.

35. The process of claim 23 wherein said electron carrying group is selected from the group consisting of oxygen, chlorine, bromine and fluorine.

36. The process of claim 23 wherein said electron carrying group comprises oxygen.

37. The process of claim 24 wherein said electron carrying group is selected from the group consisting of oxygen, halogens, and sulfur.

38. The process of claim 24 wherein said electron carrying group is selected from the group consisting of oxygen and halogens.

39. The process of claim 24 wherein said electron carrying group is selected from the group consisting of oxygen, chlorine, bromine and fluorine.

40. The process of claim 24 wherein said electron carrying group comprises oxygen.

41. The process of claim 1 wherein said reactive particulates are superthermites.

42. The process of claim 3 wherein said reactive particulates are superthermites.

43. The process of claim 1 wherein said particulates have a maximum outer diameter of 100 nm or less.

44. The process of claim 2 wherein said particulates have a maximum outer diameter of 100 nm or less.

45. The process of claim 23 wherein said particulates have a maximum outer diameter of 100 nm or less.

46. The process of claim 24 wherein said particulates have a maximum outer diameter of 100 nm or less.

47. The process of claim 8 wherein said nanoaluminum comprises particulates comprising an oxide coating having a thickness of from about 2.0 nm to about 2.5 nm.

48. The process of claim 1 wherein said compressed gas is carbon dioxide; and said collection conditions are effective to prevent formation of dry ice.

49. The process of claim 2 wherein said compressed gas is carbon dioxide; and said collection conditions are effective to prevent formation of dry ice.

50. The process of claim 3 wherein said compressed gas is carbon dioxide; and said collection conditions are effective to prevent formation of dry ice.

51. The process of claim 5 wherein said compressed gas is carbon dioxide; and said collection conditions are effective to prevent formation of dry ice.

52. The process of claim 6 wherein said compressed gas is carbon dioxide; and said collection conditions are effective to prevent formation of dry ice.

53. The process of claim 10 wherein said compressed gas is carbon dioxide; and said collection conditions are effective to prevent formation of dry ice.

54. The process of claim 11 wherein said compressed gas is carbon dioxide; and said collection conditions are effective to prevent formation of dry ice.

55. The process of claim 18 wherein said compressed gas is carbon dioxide; and said collection conditions are effective to prevent formation of dry ice.

56. The process of claim 24 wherein said compressed gas is carbon dioxide; and said collection conditions are effective to prevent formation of dry ice.

57. The process of claim 2 wherein said mixing conditions comprise a contact interval of about 2 seconds or less.

58. The process of claim 3 wherein said mixing conditions comprise a contact interval of about 2 seconds or less.

59. The process of claim 4 wherein said mixing conditions comprise a contact interval of about 2 seconds or less.

60. The process of claim 56 wherein said mixing conditions comprise a contact interval of less than about 2 seconds.

61. A process for producing a mixture comprising superthermites comprising:

forming a first dispersion comprising a first reactive particulate of the superthermite dispersed in compressed gas under agitation conditions effective to produce substantially no agglomeration, said agitation conditions comprising sonication and a temperature and pressure effective to maintain at least a portion of said compressed gas in liquid phase;

forming a second dispersion comprising a second reactive particulate of the superthermite dispersed in compressed gas under said agitation conditions;

feeding said first dispersion and said second dispersion to a mixing zone under mixing conditions effective to produce a mixed dispersion comprising said first reactive particulate of the superthermite and said second reactive particulate of the superthermite and to prevent redox reactions between said first reactive particulate of the superthermite and said second reactive particulate of the superthermite; and separating said compressed gas from said mixed dispersion under collection conditions effective to collect said mixture comprising said first reactive particulate of the superthermite and said second reactive particulate of the superthermite.

62. The process of claim 61 wherein said first and second reactive particulates of the superthermite have a thermodynamic energy density of from about 10 kJ/cc to about 20 kJ/cc.

63. The process of claim 61 wherein said first and second reactive particulates of the superthermite have a thermodynamic energy density of 17 kJ/cc.

64. The process of claim 61 wherein said first reactive particulates of the superthermite comprise aluminum, wherein the aluminum is a nanoaluminum.

65. The process of claim 62 wherein said first reactive particulates of the superthermite comprise aluminum, wherein the aluminum is a nanoaluminum.

66. The process of claim 61 wherein said superthermites comprise molybdenum.

67. The process of claim 62 wherein said superthermites comprise molybdenum.

68. The process of claim 63 wherein said superthermites comprise molybdenum.

69. The process of claim 64 wherein said superthermites comprise molybdenum.

70. The process of claim 65 wherein said superthermites comprise molybdenum.

71. The process of claim 66 wherein said molybdenum further comprises an electron carrying group.

72. The process of claim 67 wherein said molybdenum further comprises an electron carrying group.

73. The process of claim 68 wherein said molybdenum further comprises an electron carrying group.

74. The process of claim 69 wherein said molybdenum further comprises an electron carrying group.

75. The process of claim 70 wherein said molybdenum further comprises an electron carrying group.

76. The process of claim 71 wherein said electron carrying group is selected from the group consisting of oxygen, halogens, and sulfur.

77. The process of claim 71 wherein said electron carrying group comprises oxygen.

78. The process of claim 72 wherein said electron carrying group is selected from the group consisting of oxygen, halogens, and sulfur.

79. The process of claim 72 wherein said electron carrying group comprises oxygen.

80. The process of claim 73 wherein said electron carrying group is selected from the group consisting of oxygen, halogens, and sulfur.

81. The process of claim 73 wherein said electron carrying group comprises oxygen.

82. The process of claim 74 wherein said electron carrying group is selected from the group consisting of oxygen, halogens, and sulfur.

83. The process of claim 74 wherein said electron carrying group comprises oxygen.

84. The process of claim 75 wherein said electron carrying group is selected from the group consisting of oxygen, halogens, and sulfur.

85. The process of claim 75 wherein said electron carrying group comprises oxygen.

86. The process of claim 61 wherein said particulates have a maximum outer diameter of 100 nm or less.

87. The process of claim 64 wherein said nanoaluminum comprises particulates comprising an oxide coating having a thickness of from about 2.0 nm to about 2.5 nm.

88. The process of claim 65 wherein said nanoaluminum comprises particulates comprising an oxide coating having a thickness of from about 2.0 nm to about 2.5 nm.

89. The process of claim 69 wherein said nanoaluminum comprises particulates comprising an oxide coating having a thickness of from about 2.0 nm to about 2.5 nm.

90. The process of claim 70 wherein said nanoaluminum comprises particulates comprising an oxide coating having a thickness of from about 2.0 nm to about 2.5 nm.

91. The process of claim 61 wherein said compressed gas selected from the group consisting of substantially inert gases, hydrocarbons, fluorocarbons, and carbon dioxide.

92. The process of claim 61 wherein said compressed gas is carbon dioxide; and said collection conditions are effective to prevent formation of dry ice.

93. The process of claim 62 wherein said compressed gas is carbon dioxide; and said collection conditions are effective to prevent formation of dry ice.

94. The process of claim 63 wherein said compressed gas is carbon dioxide; and said collection conditions are effective to prevent formation of dry ice.

95. The process of claim 64 wherein said compressed gas is carbon dioxide; and said collection conditions are effective to prevent formation of dry ice.

96. The process of claim 65 wherein said compressed gas is carbon dioxide; and said collection conditions are effective to prevent formation of dry ice.

97. The process of claim 66 wherein said compressed gas is carbon dioxide; and said collection conditions are effective to prevent formation of dry ice.

98. The process of claim 67 wherein said compressed gas is carbon dioxide; and said collection conditions are effective to prevent formation of dry ice.

99. The process of claim 68 wherein said compressed gas is carbon dioxide; and said collection conditions are effective to prevent formation of dry ice.

100. The process of claim 88 wherein said ultrasonic conditions and said mixing conditions comprise a temperature of from about 0° C. to about 32° C. and a pressure of from about 70 bar to about 170 bar.

101. The process of claim 89 wherein said pressure is about 120 bar.

102. The process of claim 101 wherein said temperature is about 31.1° C. or less.

103. The process of claim 61 wherein said mixing conditions comprise a contact interval of about 2 seconds or less.

104. The process of claim 62 wherein said mixing conditions comprise a contact interval of less than about 2 seconds.

105. The process of claim 92 wherein said mixing conditions comprise a contact interval of about 2 seconds or less.

106. A process for producing a mixture comprising nanoaluminum and molybdenum oxide comprising:

forming a first dispersion comprising nanoaluminum dispersed in compressed carbon dioxide under agitation conditions effective to produce substantially no agglomeration, said agitation conditions comprising sonication and a temperature and pressure effective to maintain at least a portion of said compressed carbon dioxide in liquid phase;

forming a second dispersion comprising molybdenum oxide dispersed in compressed carbon dioxide under said agitation conditions;

feeding said first dispersion and said second dispersion to a mixing zone under mixing conditions effective to produce a mixed dispersion comprising said nanoaluminum and said molybdenum oxide and to prevent redox reactions between said nanoaluminum and said molybdenum oxide; and separating said compressed carbon dioxide from said mixed dispersion under collection conditions effective to collect said mixture comprising said nanoaluminum and said molybdenum oxide.

107. The process of claim 106 wherein said nanoaluminum comprises particulates comprising an oxide coating having a thickness of from about 2.0 nm to about 2.5 nm.

108. The process of claim 106 wherein said agitation conditions and said mixing conditions comprise a temperature of from about 0° C. to about 32° C. and a pressure of from about 70 bar to about 170 bar.

109. The process of claim 108 wherein said pressure is about 120 bar.

110. The process of claim 109 wherein said temperature is about 31.1° C. or less.

111. The process of claim 106 wherein said agitation conditions comprise a solids loading of about 5% or less.

112. The process of claim 106 wherein said agitation conditions comprise a solids loading of about 2 wt. % or less.

113. The process of claim 108 wherein said agitation conditions comprise a solids loading of about 5% or less.

114. The process of claim 108 wherein said agitation conditions comprise a solids loading of about 2 wt. % or less.

115. The process of claim 109 wherein said agitation conditions comprise a solids loading of about 5% or less.

116. The process of claim 109 wherein said agitation conditions comprise a solids loading of about 2 wt. % or less.

117. The process of claim 110 wherein said agitation conditions comprise a solids loading of about 5% or less.

118. The process of claim 110 wherein said agitation conditions comprise a solids loading of about 2 wt. % or less.

119. The process of claim 106 wherein said agitation conditions comprise magnetically coupled stirring effective to produce an axial flow pattern comprising axial currents that follow mixing vessel geometry outward from a magnetically coupled stirrer to a vessel wall.

120. The process of claim 119 wherein said magnetically coupled stirring produces a turbulent flow in said dispersion mixture at a rate of about 6 nm at about 2500 rpm.

121. The process of claim 106 wherein said mixing conditions comprise a contact interval of about 2 seconds or less.

122. The process of claim 108 wherein said mixing conditions comprise a contact interval of about 2 seconds or less.

123. The process of claim 109 wherein said mixing conditions comprise a contact interval of about 2 seconds or less.

124. The process of claim 110 wherein said mixing conditions comprise a contact interval of about 2 seconds or less.

125. The process of claim 111 wherein said mixing conditions comprise a contact interval of about 2 seconds or less.

126. The process of claim 112 wherein said mixing conditions comprise a contact interval of about 2 seconds or less.

127. The process of claim 117 wherein said mixing conditions comprise a contact interval of about 2 seconds or less.

128. The process of claim 118 wherein said mixing conditions comprise a contact interval of about 2 seconds or less.

129. The process of claim 119 wherein said mixing conditions comprise a contact interval of about 2 seconds or less.

130. The process of claim 120 wherein said mixing conditions comprise a contact interval of about 2 seconds or less.

131. The process of claim 106 wherein said mixing conditions comprise a contact interval of less than 2 seconds.

132. The process of claim 120 wherein said mixing conditions comprise a contact interval of less than 2 seconds.

133. The process of claim 106 further comprising providing a static free environment.

134. The process of claim 110 further comprising providing a static free environment.

135. The process of claim 117 further comprising providing a static free environment.

136. The process of claim 118 further comprising providing a static free environment.

137. The process of claim 120 further comprising providing a static free environment.

138. The process of claim 128 further comprising providing a static free environment.

139. The process of claim 129 further comprising providing a static free environment.

140. The process of claim 130 further comprising providing a static free environment.

* * * * *